United States Patent [19]

Mahr

[11] 4,094,494

[45] June 13, 1978

[54] FURNACE CHARGE PROFILE MEASURING PROCESS AND APPARATUS

[75] Inventor: René N. Mahr, Howald-Hesperange, Luxembourg

[73] Assignee: S. A. des Anciens Etablissements Paul Wurth, Luxembourg, Luxembourg

[21] Appl. No.: 762,781

[22] Filed: Jan. 25, 1977

[30] Foreign Application Priority Data

Feb. 9, 1976 Luxembourg ..... 74321

[51] Int. Cl.[2] ..... C21B 7/24

[52] U.S. Cl. ..... 266/44; 266/92; 266/183

[58] Field of Search ..... 214/17 CB, 18 V, 35 R; 266/44, 92, 183, 184, 197

[56] References Cited

U.S. PATENT DOCUMENTS

| | | | |
|---|---|---|---|
| 951,128 | 3/1910 | Johnson, Jr. | 266/184 X |
| 3,230,363 | 1/1966 | Prellwitz | 266/184 X |
| 3,588,067 | 6/1971 | Shimotsuma et al. | 266/92 X |
| 4,026,427 | 5/1977 | Greaves et al. | 266/184 X |

*Primary Examiner*—Roy Lake
*Assistant Examiner*—Paul A. Bell

[57] ABSTRACT

The surface contour of material deposited on the hearth of a furnace is sensed by measuring the height of the material on the furnace axis and at a plurality of points about the periphery of the furnace. The height on the furnace axis is measured with an instrument mounted on the axis of a furnace having an internally mounted steerable material distribution chute with the instrument being positioned vertically above the chute and the feed channel through which charge material is delivered to the chute.

1 Claim, 4 Drawing Figures

FURNACE CHARGE PROFILE MEASURING PROCESS AND APPARATUS

BACKGROUND OF THE INVENTION (1) Field of the Invention

The present invention relates to determination of the contour of a surface from a position located remotely of the surface and particularly to measuring the profile of the surface of charge material which has been deposited on the hearth of a furnace. More specifically, this invention is directed to apparatus for use in determining the profile of the surface of the burden in a shaft furnace and particularly a blast furnace employing a bell-less charging installation. Accordingly, the general objects of the present invention are to provide novel and improved methods and apparatus of such character.

(2) Description of the Prior Art

It is well known that proper exercise of control over the profile of the burden of a blast furnace is essential to maximizing the efficiency of operation of the furnace; i.e., the exercise of control over the charge profile is necessary in the interest of insuring that the furnace throat gases will pass through the charge in the optimum manner. Thus, by way of example, if the level of the burden is too low at the center of the furnace in comparison with its level at the periphery, for example as a result of excessively rapid subsidence at the center, the distribution of the various materials with which the furnace is being charged can not be accurately controlled since certain materials will tend to become concentrated in the centers and others at the periphery in accordance with their granulometric configuration and the angle of the slope formed by the materials. The resulting "V" shaped charge profile tends to become accentuated since the greater of the depth of the "V" at the center of the furnace the more the furnace will "draw" in that position with consequently more rapid descent of the central part of the burden. If, on the other hand, the "V" shape of the charge profile is very slight, or if the level of the charge is higher at the center than at the periphery of the furnace, there is a risk that the furnace will "draw" mainly at its periphery. This phenomenon is known in the art as "peripheral movement" and causes an excessive temperature rise in the refractory walls of the furnace.

It is also known that the surface contour assumed by charge material deposited on the hearth of a blast furnace; i.e., the profile of the furnace burden; is essentially determined by two factors. The first of these factors is the manner in which the material is distributed when introduced into the furnace. The second profile determinative factor is the nature of the uneven descent of the material as it falls under the influence of gravity to the hearth after having been introduced into the furnace.

Two basic types of shaft furnace charging devices are presently known in the art. The first, which has been in use for many years, employs two superimposed charging bells. In charging installations employing such charging bells, the profile of the charge surface is determined solely by the descent of the charge material inside the furnace and it is well known that a depression or hollow is unavoidably formed at the center of the furnace; i.e., the charge profile has a characteristic M-shaped curve. The second category of charging device is a bell-less system which employs a rotatable and angularly adjustable charge distribution spout. Such a bell-less charging installation is shown and described in U.S. Pat. No. 3,693,812. Use of a bell-less charging installation with a steerable spout makes it possible to distribute the charge material in any desired manner on the furnace hearth and also to compensate for any changes which may occur as a result of a localized or uneven subsidence of the burden on the furnace hearth. Thus, a bell-less charging installation such as that described in U.S. Pat. No. 3,693,812 enables the exercise of a high degree of control over the way in which the surface profile of the burden on the furnace hearth develops. This desirable degree of control, however, may be exercised only if the existing charge profile can be determined.

As should be obvious from the above brief discussion, the development of devices which enable the profile or surface contour of the burden on the hearth of a furnace to be measured has attracted considerable attention. Efforts aimed at the development of such "profilometers" have been particularly intense since bell-less charging installations, wherein the charge material may be distributed as desired on the furnace hearth, have become available. However, prior to the present invention, there have been no reliable devices available which enabled the profile of the burden in the shaft furnace to be accurately determined.

The prior art charge profile measuring technique most frequently employed utilized one or more vertically movable probes. These probes were conventionally of the mechanical type, although radiation type probes have been proposed, and were distributed around the periphery of the furnace. These prior mechanical probes consist of rods or chains which are lowered vertically until the surface of the burden is contacted in order to determine the level of the burden in the vicinity of the furnace periphery. While these vertically movable mechanical probes offer the dual advantages of accurate measurement and lack of complexity, they suffer from the serious drawback of being able to indicate the height of the furnace burden only at a few peripheral points. Thus, prior art techniques provided very little information on the profile of the burden as a whole, particularly in the central zone.

It is to be observed that the advent of bell-less charging installations has made it possible to widen the annular zone, extending inwardly from the furnace wall, which may be sensed employing peripheral vertical probes. This enlargement of the area of the charge surface which may be probed results from the fact that the location of the probes is no longer impeded by the lower bell and impact ring of the prior bell-type charging devices. Nevertheless, even with the widened annular zone which can be sensed employing peripheral probes in modern blast furnaces, information concerning the charge height at the center of the furnace is still necessary in order to provide adequate information on the charge profile.

In view of the previous inability to sense the level of the burden on a furnace hearth at the center of the furnace through the use of a reliable mechanical probe, and particularly a movable probe, there have been attempts to perfect profile measuring instruments which emit beams or pulses of light or electromagnetic, ultrasonic or nuclear radiation. Such instruments, if they could be developed, would have the capability of being able to obtain a total representation of the profile over the entire surface of the burden. These radiation based profilometers, while offering a theoretical solution to the problem of measuring the charge profile within a shaft furnace, have to date been unsuccessful. The lack of success may be attributed to the exceedingly difficult operating conditions which include high temperature and pressure and the presence of a significant amount of dust.

SUMMARY OF THE INVENTION

The present invention overcomes the above briefly discussed and other deficiencies and disadvantages of the prior art by providing a device for determining the level of a shaft furnace burden at the center of the furnace with sufficient accuracy to enable, in cooperation with peripheral probes, the charge profile to be monitored. The present invention also encompasses a process for measuring and thus controlling the development of the charge profile on the hearth of a furnace for the purpose of compensating for irregularities which occur during the course of charging the furnace.

The present invention includes a probe mounted on the longitudinal axis of a shaft furnace above a rotatable and angularly adjustable charge distribution chute or spout; the probe of the present invention also being mounted above and thus operating through the feed channel via which the furnace burden is delivered to the distribution chute. Use of this axially mounted probe, in conjunction with a plurality of probes positioned about the periphery of the furnace, provides data from a sufficient number of measuring points to enable the profile of the entire surface of the burden to be predicted with the requisite accuracy. Restated, the knowledge of the level of the charge at different points on the periphery and also at the center of the surface of the burden provides the information necessary to obtain distribution of the charge on the furnace hearth in the optimum manner.

In accordance with a first embodiment of the invention, the axially mounted charge burden level measuring device consists of a mechanical probe including a probe foot suspended from a cable and capable of being lowered through the central feed channel and onto the center of the surface of the burden by means of a suitable control mechanism.

In accordance with a second embodiment of the invention the probe comprises a radiation emitter, for example a radar transmitter antenna, which emits radiation in the direction of the surface of the burden; the transmitting antenna cooperating with a receiving antenna also mounted within the charging installation above the distribution chute and feed channel.

The invention also encompasses a process for monitoring the development of the surface profile of a shaft furnace burden wherein, by means of a bell-less charging installation including a rotary spout with an adjustable angle of inclination, the charge material is deposited on the hearth in concentric circles or in a spiral configuration starting from the furnace periphery. The process of the present invention is characterized by determination of the charge profile, in accordance with a predetermined program, each time the distribution chute is oriented such that its axis is parallel to the longitudinal axis of the furnace.

The measuring process in accordance with the present invention, in accordance with a further embodiment, contemplates moving the distribution chute to a predetermined position during the probing operation using an axially mounted mechanical probe. In this mode of operation the chute will, as its angle of inclination is varied, move the probe away from the longitudinal axis of the furnace whereby the position of the probe on the burden with relation to the furnace axis will depend upon the angle at which the chute is inclined. The moving of the mechanical probe to positions radially displaced from the furnace longitudinal axis enables the obtaining of data from measuring points which would normally lie in an annular region between the innermost peripheral probes and the furnaces axis.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENTS

Figure 2:
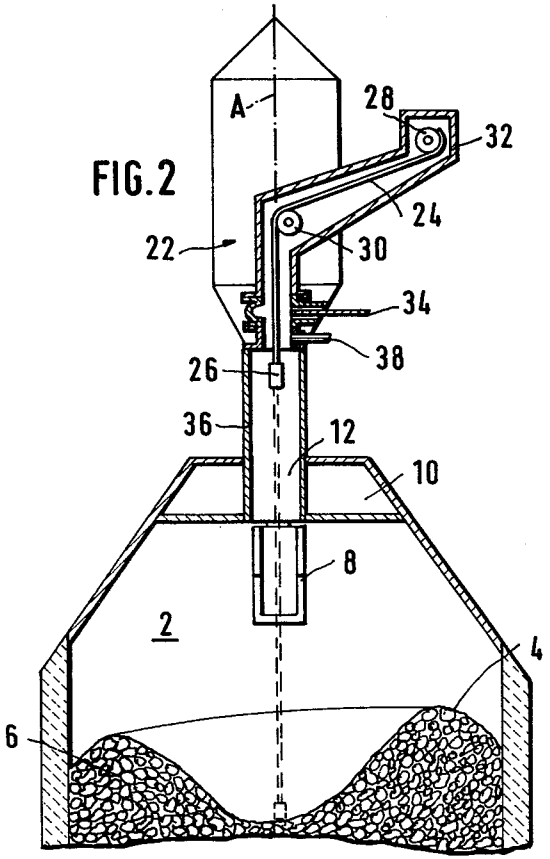
FIG. 2 is a schematic showing, taken transverse to the showing of FIG. 1, of the apparatus of FIG. 1.
Figure 1:
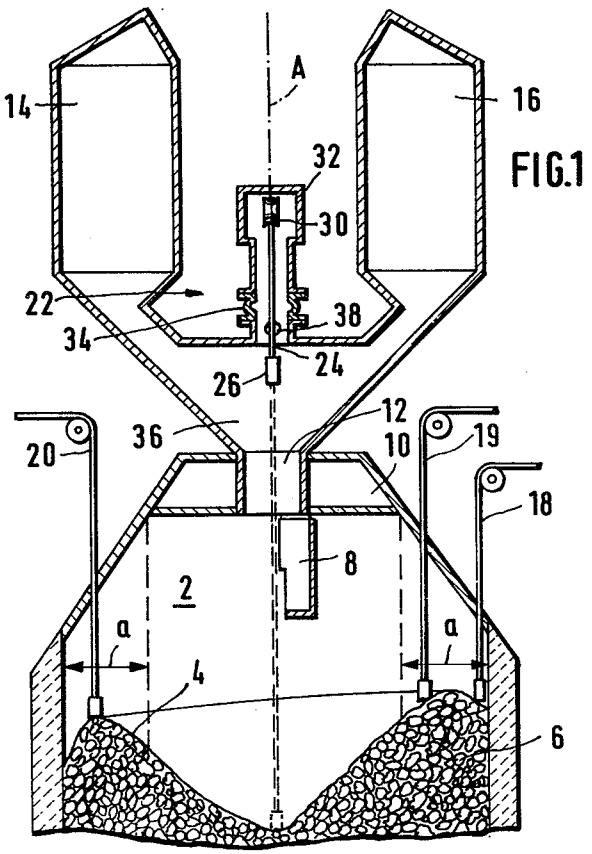
FIG. 1 is a schematic diagram representing a longitudinal section through a furnace, employing a bell-less charging installation, having installed therein a probe device in accordance with a first embodiment of the invention.

Referring jointly to FIGS. 1 and 2, the throat of a shaft furnace has been indicated generally at 2. The object of the present invention is to determine the profile of the surface 4 of the burden 6 deposited on the hearth of the furnace so as to enable control of the furnace charging operation to achieve the distribution commensurate with maximum furnace efficiency. Thus, in accordance with the invention, the shape or profile of the upper surface 4 of the burden 6 is to be determined by sensing the vertical height, above the hearth, of surface 4 at a sufficient number of points so as to enable the charge profile to be determined. As shown in FIGS. 1 and 2, the profile of surface 4 includes a central cavity corresponding to the well known "V" or "M" profiles which are characteristic of the delivery of the charge to the furnace via a prior art bell-type charging installation.

Figure 3:
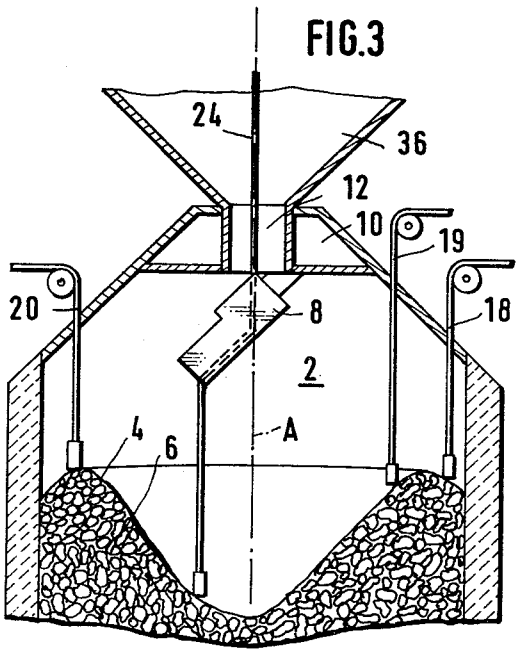
FIG. 3 is a schematic representation of a method of use of the apparatus of FIGS. 1 and 2.

As noted, the present invention is to be used with a bell-less charging installation which consists of a rotary chute 8 which may be adjusted, as shown in FIG. 3, so as to vary the angle of inclination of the chute with respect to the longitudinal axis A of the furnace. The chute 8 is driven by a suitable driving mechanism mounted in an annular chamber 10. Chamber 10 is mounted about a central feed channel 12 through which the charge material is delivered to chute 8. A pair of feed hoppers 14 and 16 alternately deliver the furnace charge material or burden to the upstream end of feed channel 12. For a further discussion of the structure and operation of a bell-less charging installation employing a steerable charge distribution chute, reference may be had to aforementioned U.S. Pat. No. 3,693,812 and also to U.S. Pat. Nos. 3,814,403; 3,864,984 and 3,880,302; all of said patents being assigned to the assignee of the present invention.

As depicted in FIGS. 1 and 2, the distribution chute 8 has been oriented such that its axis is parallel to the longitudinal axis A of the furnace. With chute 8 in this position any charge material delivered to the upstream end of feed channel 12 would, of course, fall vertically onto the center of the surface 4 of the burden 6.

In accordance with the embodiment of FIGS. 1–3, peripheral probes of the type known in the art are installed in the throat 2 of the furnace for the purpose of determining the level of the surface 4 of burden 6 in an annular region extending inwardly a distance "*a*" from the wall of the furnace. In FIG. 1 three of these peripheral probe devices 18, 19 and 20 are depicted. It is to be noted that, with the bell-less charging installation, it is possible to place two or more probes on the same radius as indicated in the case of probe devices 18 and 19. The probes may, of course, also be distributed at different radial distances over the entire peripheral region of the charge of width "*a*"; the number of probes employed being determined by the degree of accuracy desired for the charge profile measurement. The peripheral probe devices 18, 19 and 20 will not be described in detail since they are of the type well known in the art. Thus, suffice it to state that the peripheral probe devices may each consist of either a rod, cable or chain having a probe foot suspended at the end thereof for vertical movement. Alternatively, although not shown in the drawing, the peripheral probes may consist of suitable radiation emitters and receivers.

Although the width "*a*" of the annular zone which may be probed utilizing the prior art probes such as 18, 19 and 20 is considerably larger in the case of a bell-less charging installation than with a bell-type charging installation, it is nevertheless still necessary to sense the height of surface 4 at the furnace axis A. By way of example, it can be seen from FIG. 1 that probes 18 and 19, in the case of a characteristic "M" shaped profile, will provide substantially the same meaurement and will not give information from which the level of surface 4 at the furnace axis may be extrapolated. However, as noted above, the level of the burden at the center is the decisive factor for the operation of the furnace.

In accordance with the present invention an axially located probe, indicated generally at 22, will be installed in the upper part of the furnace charging installation on a prolongation of the longitudinal axis A of the furnace. Probe 22 may be similar to one of the peripheral probes such as probes 18, 19 and 20 and thus may comprise a chain or cable 24 from which, at the lower end, is suspended a probe foot 26. The chain or cable 24 may be wound onto or unwound from a pulley 28, passing over a guide pulley 30 as the probe foot 26 is lowered and raised, by means of a suitable driving mechanism which has not been shown in the drawing. The pulleys 28 and 30 are located inside a housing 32 which is hermetic with respect to the ambient atmosphere surrounding the furnace. Thus, during operation of the furnace, the interior of housing 32 will customarily be at the pressure which prevails within the furnace.

A valve 34 cooperates with housing 32 to isolate the interior of the housing from the interior of the furnace. When it is desired to so isolate the interior of housing 32, for example when the servicing of a component of the probe 22 is required, the probe foot 26 will be raised beyond the position shown in solid lines such that the foot 26 is located vertically above valve 34.

It is customary to deliver a pressurized and cooled gas to the interior of a bell-less charging installation either continuously or intermittently. The purpose of this pressurized coolant, which may be an inert gas such as nitrogen or purified and cooled furnace throat gas, is to create a counterflow downwardly through the charging installation in the interest of reducing the amount of corrosive dust deposited on the metal parts of the charging installation and also to provide a cooling effect for these metal parts. In accordance with the present invention, the coolant supply conduit is coupled to an orifice 38 provided in the housing 32 at the furnace side of valve 34. Accordingly, in normal operation, the probe foot 26 is also exposed to the downward flow of the cleaning and cooling gas.

The axial or central probe 22 is used in the same manner as the peripheral probes 18, 19 and 20. When the height of the surface 4 of burden 6 is to be sensed, the cable 24 is unwound by actuating pulley 28. Contact of probe foot 26 with the surface of the charge is determined, by means known in the art and not shown in the drawing, and the height of the burden in the place where the probe foot is resting will be determined by measuring the length of cable which has been unwound. As will be obvious to those skilled in the art, a rod or chain may be employed as an alternative to the cable 24. As will also be obvious to those skilled in the art, during the time the charge profile is being measured the charging of the furnace will be interrupted and the chute 8 immobilized.

In FIGS. 1 and 2 the probe 22 is shown in broken lines in the sensing position; i.e., the position where the probe foot 26 has been let down onto the surface 4 of the burden; and in solid lines in the raised position which the probe must occupy during the charging of the furnace.

Employing the apparatus of FIGS. 1 and 2, the charge profile may be determined either by simply employing the technique shown in FIGS. 1 and 2 or, if additional accuracy is necessary, by employing the technique represented by FIG. 3. In FIGS. 1 and 2 the chute 8 is turned such that it is aimed vertically downwardly and the cable 24 is unwound from pulley 28 so as to lower the probe foot 26 onto the surface 4 of the burden 6. As soon as the surface of the charge burden is contacted the amount of cable played out will be measured and the probe immediately raised again so that the charging of the furnace can be continued. This technique is particularly suitable when the charging process disclosed in U.S. Pat. No. 3,929,240 is employed. The charging process of U.S. Pat. No. 3,929,240 contemplates deposition, of the material fed into the furnace via the feed channel 12, of the charge on the hearth in concentric circles or in a spiral configuration starting at the furnace periphery. Thus, in accordance with the patented process, the angle of inclination of the chute 8 with respect to the longitudinal axis A of the furnace is reduced either in a programmed step-by-step manner or gradually. The height of the center of the surface of the burden may be sensed at the end of each cycle; i.e., each time a fresh layer of burden has been deposited; when the spout is turned completely down as shown in FIG. 1. Alternatively, the sensing of the charge contour may be carried out intermittently such as, for example, at the end or at the beginning of every second or third charging cycle. The probing may also be scheduled on the basis of time.

Referring to FIG. 3, the present invention offers the capability of employing the axially mounted probe to sense the height of the surface 4 of burden 6 at points displaced radially outwardly from the axis of the furnace. Thus, the present invention may be employed to measure that annular region of the charge surface displaced inwardly from the peripheral region of width "*a*" and outwardly from the center of the furnace. In order to accomplish this additional measurement the chute 8 will be inclined, as represented in FIG. 3, so as to move the probe foot radially away from the longitudinal axis A of the furnace. The process may be repeated at different angular orientations of chute 8 with the probe foot being allowed to descend for the purpose of a fresh measurement after each movement of the chute. As will be obvious, the probe foot 26 can thus be swept over a comparatively large area of the surface 4 of burden 6 by using the chute 8 as a probe steering mechanism. The position of the probe on the surface will, employing the technique of FIG. 3, be a function of the angle of inclination of chute 8 and the measured length of cable 24 must be corrected in accordance with the chute inclination.

From the foregoing description it may be seen that the present invention provides a blast furnace operator with a simple and efficient means which enables the level of a sufficient number of points to be determined so as to provide data representative of the profile of the entire surface of the burden. In the embodiment of FIGS. 1 and 2 the points wherein the charge height is measured are fixed whereas, employing the technique of FIG. 3, some of the points may be arbitrarily selected.

Figure 4:
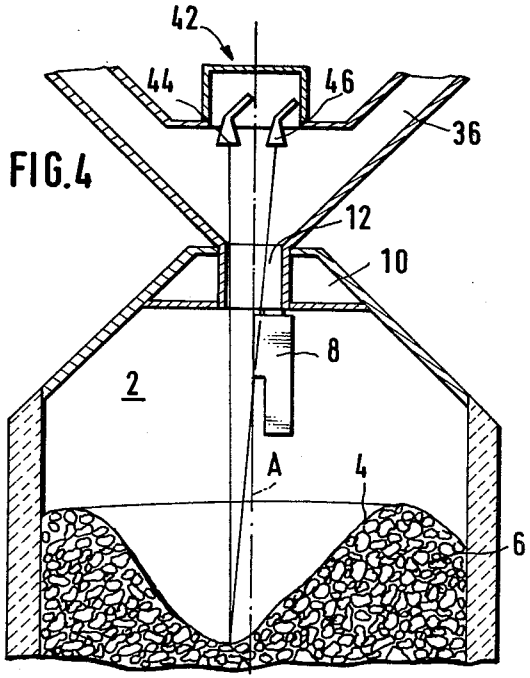
FIG. 4 is a schematic diagram representing a longitudinal section of a portion of a furnace having installed therein a probe in accordance with a second embodiment of the invention.

Referring now to FIG. 4, a radar type probe is schematically represented generally at 42. The radar probe comprises a transmitting antenna 44, which emits electromagnetic radiation vertically in the direction of the surface of the burden, and a receiving antenna 46, which is responsive to energy reflected from the charge surface. In the manner well known in the art, the time between transmission and reception may be employed to calculate the distance between the probe and the charge surface directly below transmitting antenna 44. The details of such a radar probe being known in the art, for example as shown in Luxembourg Pat. No. 70,310, and the invention thus residing in the positioning of the antennas 44 and 46, the construction of the embodiment of FIG. 4 will not be further described herein. It is to be noted, however, that the antennae can be caused to perform an oscillating movement so that the transmitted beam may sweep over a small area which includes the center of the discharge; the amount of sweeping possible being limited by the dimensions of the feed channel 12. As will also be obvious, the chute 8 must be turned completely down during use of the embodiment of FIG. 4 and, of course, the charging process must be interrupted during scanning. The embodiment of FIG. 4 offers the advantage, by comparison with mechanical probes, that scanning is affected much more rapidly since the time required for raising and lowering a probe foot is saved. The radar probe could, within the scope of the present invention, be replaced by other similar radiation emitting distance measuring equipment.

Returning again to a consideration of the embodiment of FIGS. 1 and 2, the axially mounted probe foot 26 may advantageously be combined with a temperature measuring and/or gas sampling device. In the case of a temperature sensor, a thermal detector may be made integral with probe foot 26 and the measured temperature transmitted to the exterior of the furnace by means of an electrical conductor installed in cable 24. Gas collected by a sampling device would similarly, employing conduits and suitable valves, be conveyed to the exterior of the furnace.

While a preferred embodiment has been shown and described, various modifications and substitutions may be made thereto without departing from the spirit and scope of the invention. Thus, by way of example, data concerning the profile of the burden measured in accordance with the present invention may be stored and subsequently used for automatic control of the charging installation. Accordingly, it will be understood that the present invention has been described by way of illustration and not limitation.

What is claimed is:

1. A process for monitoring the development of the surface of the charge burden on the hearth of a shaft furnace, the furnace employing a rotatable and angularly adjustable distribution chute which extends downwardly on the axis of the furnace, the angle of the chute with respect to the axis of the furnace being adjustable to deposit furnace charge material in a predetermined pattern, said process including the steps of:

inclining the distribution chute such that its axis is at a preselected angle with respect to the axis of the furnace;

lowering a probe initially axially with respect to the furnace until it contacts the charge surface, the probe being deflected from the furnace axis by the distribution chute;

measuring the distance traveled by the probe until contact with the charge surface has been established;

correcting the measured distance in accordance with the angular inclination of the distribution chute; and withdrawing the probe from the charge surface.

* * * * *